United States Patent [19]

Garner et al.

[11] Patent Number: 4,998,902

[45] Date of Patent: Mar. 12, 1991

[54] TOPPLING TOY

[75] Inventors: Harold E. Garner, Long Beach; Merrill M. Miller, Lomita; Brian E. Kavanagh, San Pedro; Gorden W. Spring, Long Beach, all of Calif.

[73] Assignee: Universal Product Innovations, Inc., Carson, Calif.

[21] Appl. No.: 488,709

[22] Filed: Mar. 5, 1990

[51] Int. Cl.[5] ..... A63H 33/04; A63H 33/00; A63B 71/00; A63F 1/02

[52] U.S. Cl. ..... 446/2; 446/487; 273/293; 273/148 R

[58] Field of Search ..... 446/2, 3, 4, 478, 487, 446/491; 273/292, 293, 294, 295, 127 R, 127 D, 148 R, 148 A

[56] References Cited

U.S. PATENT DOCUMENTS

| | | | |
|---|---|---|---|
| 1,225,454 | 5/1917 | Mandel et al. | 273/294 X |
| 2,289,690 | 7/1942 | Bakalyar | 446/2 |
| 2,587,042 | 2/1952 | Haiselup | 446/2 |
| 2,713,489 | 7/1955 | Glaser | 446/2 X |
| 2,776,835 | 1/1957 | Wilson | 446/2 X |
| 3,315,404 | 4/1967 | Rosen | 446/2 |
| 3,429,067 | 2/1969 | Yancey | 273/127 R |
| 3,621,601 | 11/1971 | Greenberg | 446/2 |
| 4,138,797 | 2/1979 | Stolar | 273/127 D X |
| 4,438,586 | 3/1984 | Wildman et al. | 446/2 |
| 4,632,664 | 12/1986 | Manning | 446/2 |
| 4,740,185 | 4/1988 | Inglee | 446/2 |
| 4,880,235 | 11/1989 | Groenewold | 446/2 X |

FOREIGN PATENT DOCUMENTS

| | | | |
|---|---|---|---|
| 548858 | 4/1932 | Fed. Rep. of Germany | 446/2 |
| 2218689 | 4/1972 | Fed. Rep. of Germany | 446/2 |

OTHER PUBLICATIONS

Pressman Toy Co. 1989, Catalogue, p. 40, "Domino Rally".

*Primary Examiner*—Robert A. Hafer
*Assistant Examiner*—D. Neal Muir
*Attorney, Agent, or Firm*—Ronald M. Goldman

[57] ABSTRACT

An improved toppling toy is characterized by a resetting capability that comprises a plurality of finger tip operated actuators, each of which is associated with and coupled to an associated one of the pivotally mounted tiles for joint pivotal movement therewith; and each actuator contains an outer actuator surface exposed on the upper surface of the track to a players finger, such outer surface having a frictional characteristic, whereby dragging movement of the players finger along a finger dragging lane on the track and across and transverse the actuator when the tile is in the down position causes pivoting of the actuator and thereby uprights the associated tile. Suitably the actuator and tile are formed in a unitary one piece structure of molded plastic material. A novel track contains rods to serve as a pivot for the tiles and is also formed of a unitary one piece assembly of molded plastic material.

27 Claims, 1 Drawing Sheet

TOPPLING TOY

FIELD OF THE INVENTION

This invention relates to a "domino effect" toppling toy and, more particularly, to an improved toppling toy structure that permits quick and easy upright positioning of the numerous spaced tiles, flags, blocks, dominoes or other figures of the toy, prepatory to toppling.

BACKGROUND

To find amusement persons have taken the small rectangular wooden pieces of the game of dominos, stood the pieces upright on a narrow end in spaced relationship with one another to form a line of upstanding dominos and then tipped over the first domino in the line, causing the remaining ones to topple in sequence, creating the often referred to "domino effect". That use of dominos illustrates a toppling toy in its simplest form. Recognizing interest in amusement of that kind, more sophisticated forms of toppling toys followed.

Known toppling toys have been formed with one or more base or track sections, as variously termed, each of which is provided with a series of pivotally mounted upright dominos, blocks, flags, chips, figures or tiles, as may be collectively referred to as "tiles", positioned spaced apart on the track so that when one of the tiles of a row of tiles is toppled over, that toppling tile engages an adjacent one, which in turn tips over and engages the tile adjacent to it and so on, seriatim, until the whole row of tiles is moved in succession to a down, off-the-vertical position, with the end of each tile laying in overlapping relationship with an adjacent tile. By extending the base or track, with both curved and straight track sections, and adding additional tiles as appropriate a large number of creative toppling configurations may be made.

The present invention is of the foregoing kind and includes that known relationship. Not only may the track configurations assume different form, but the tiles may differ in size, shape and decoration as well as long as the height and spacial relationship between tiles is such as to properly engage an adjacent tile. As is known the tiles may also contain letters or other decoration so as to reveal a message when toppled and, further, may be other than a rectangular shape. The tiles may also be made of a hard substance so that when one tile tips and strikes the next, an audible sound, such as a click, may be heard, adding further drama to the amusement. A wide range of known variations to the elements are possible in such a toy and, hence, in the improved toppling toy that is the subject of the present invention. Once the tiles are toppled, in order to continue play anew the tiles must necessarily be uprighted. With actual dominoes resetting may take considerable time and careful effort.

Accordingly, an object of the present invention is to provide a new toppling toy structure in which individual tiles may be uprighted by the player, quickly and efficiently.

That objective in toppling toys has previously been explored by others from time to time. German Patent no. 548,858 granted Apr. 20, 1932 to Heinrich presents a topping toy having a plurality of toppling blocks pivotally mounted on a thick track like base. Attached to each block is a small flag-like tongue element that extends to the side of the associated block and off of the thick track. When one block is toppled, the remaining blocks topple in succession. As each block topples, the attached tongue element pivots downwardly from a horizontal position to a vertical position, extending downwardly from the pivot axis along the track side and below the tracks upper surface. Because the track is thick the end of the tongue does not however reach to the floor or other surface on which the track rests. The blocks are reset to the upright position by the player passing his hand along and sequentially engaging the now vertically oriented tongues, forcing the tongues to pivot from the vertical position back to the horizonal position, moving the associated connected tile to the upright position. To enhance stability when the blocks are upright, the pivot axis for the block is at one edge. Hence when uprighted the center of gravity of the block is off the pivot axis and the other edge of the block engages the track surface. Heinrich thus offers a convenient and quick acting means to reset the toppled blocks into an upright position.

Although one may conclude that the Heinrich structure operates successfully, that structure contains many pieces to put together a tile assembly; it would appear that such structure is not ideally suited to manufacture by modern plastics molding processes in a manner that minimizes the number of separate pieces and the complications of assembly and, hence the expense of manufacture. An additional object of the present invention, accordingly, is to provide a structure for a toppling toy that is easily manufactured by injection molding plastic fabrication technique and that may be easily packaged with minimal detached parts for easy unpackaging and assembly by the player. A still additional object of the invention is to provide a toppling toy structure that is produced inexpensively by plastic molding processes and in which the tile and resetting mechanism may be formed in a one piece unitary assembly.

The desire for quick resetability of fallen pieces was recognized more recently in U.S. Pat. No. 3,621,601 granted Nov. 23, 1971 to Greenberg et al and in U.S. Pat. No. 4,740,185 granted Apr. 26, 1988 to Inglee.

In Greenberg a structure for a toppling toy pivotally mounts blocks to a track base. The pivot is formed by a pair of spaced tab members that extend on resilient arms from the bottom of the tile; the tabs are squeezed together into a slot opening in the base. Once in the opening and released the members spread apart, essentially latching the tile to the base, with sideways extending tabs preventing withdrawal from the base. The tile is effectively snap locked to the base. In the upright position the tile bottom rests on the surface of the track and prevents the tile from falling backward in the wrong direction. By making the tiles bottom surface or base slightly inclined to the normal, the tile leans backward slightly so that gravity enhances the stability of the tile while in its upright position.

Once the blocks in the Greenberg structure are toppled, they are reset upright by uplifting an end of the track or simply turning the whole track assembly upside down, the snap lock preventing the tiles from dropping off the track. The force of gravity flips the tiles back to an upright position, and the track is thereafter carefully lowered back to a horizontal position, ready for re-use. The Greenberg structure is thus simple and is efficiently reset. As one appreciates in an arrangement in which track sections are mechanically coupled together and complicated forms of sections and curves are included in the track construction it is often not feasible to over-turn or even tilt up an end of the track without complicated and/or time consuming effort. Although the present invention also permits resetting the tile positions by tilting the track, an object of the invention is to allow resetting of the tiles to the upright position without lifting or tilting the track section and without overturning the track section.

The Toppling Toy and Construction Set presented in Inglee uses a set of dominoes in which each domino is modified to install conventional pivot pins on each of the left and right hand side that engage corresponding upstanding pivot pin receiving posts, upwardly extending from a track like base. The modified dominoes are inserted into place upright into the corresponding pivot posts. A stop is molded in the track adjacent one side of each domino. The stop engages the bottom side of the associated domino to prevent the domino from pivoting from the upright position to the wrong down side. Each domino in its upright position is tilted slightly backward, perhaps five degrees from the vertical, to lend stability. Once the dominoes are in the down position they are reset by hand or, recognizing the desire to do so quickly; by carefully lifting and tilting the track section backward, as in the prior Greenberg structure, to upright the dominoes, followed by carefully setting the track section down. Although the dominoes in Inglee appear complex to form with the pivots, once formed, the dominoes are easily assembled into place in the track by insertion onto the pivot posts. The dominoes cannot be reversed in position and allowed to fall in the opposite direction as the stop prevents the dominoes from falling in that direction.

Therefore a further object of this invention is to provide in the toppling toy easy and quick raising of the tiles to the upright position without the need to lift and tilt the track and to provide reversibility, to allow for easy assembly of the tile into the track so the tile may be oriented to fall in either direction as selected by the player.

An apparent limit to mechanized resetting of the tiles appears to have been attained by Bakalyar in U.S. Pat. No. 2,289,690 granted July 14, 1942 for a toppling Toy with simulated dominos. The Bakalyar structure discloses a more fully automatic mechanical arrangement. That structure includes a base and pivotally mounted dominoes that achieve the domino effect upon toppling the first tile in the line, causing it to tip into the next adjacent tile and so on until the last tile in the group falls down seriatim. A series of rods or cranks underlie and extend along the bases of the track and are mechanically linked to the dominoes. By manipulating the rods in a direction longitudinal of the track the player resets the dominoes to the upright position. Bakalyar thus recognizes the desire to quickly reset a group of dominoes to the upright position in his mechanical domino set, as does the present invention, and provides a highly complex structure as solution.

An advantage to the present invention is that easy resetability of the tiles is provided without the need for hand grip manipulation of elongated rods and cranks as taught in Bakalyar. Though less mechanized than the Bakalyar structure, the present invention achieves a like result.

SUMMARY OF THE INVENTION

In light of foregoing background and in accordance with the previously expressed objects of and advantages to the invention the improved toppling toy of the present invention includes a track or base portion, a series of spaced upright tiles having their lower ends pivoted to said base to permit the upper ends of the tiles to swing to inclined positions in one direction, with the tiles spaced apart such a distance from one another as to permit a falling tile at one end of a row of tiles to engage an adjacent upright tile and cause it to tip over, and containing resetting means to return the fallen tiles to their normal upright positions in progressive order. The present improvement therein is characterized by a resetting means that comprises a plurality of actuators, one of which is associated with and coupled to a corresponding one of the tiles for joint pivotal movement therewith; and each actuator contains an outer surface exposed on the upper surface of said track to a players finger, such outer actuator surface having a frictional characteristic, whereby dragging the players finger along the track and across and transverse the actuator causes the actuator to pivot and thereby upright the associated tile.

The track may be said to effectively contain an imaginary lane dedicated as a roadway for the players finger; a finger dragging lane. That lane permits the player to drag his finger along the lane, engage and operate, that is pivot, each actuator in sequence. As the finger engages and pivots one actuator, the players finger is moved to the next actuator along the lane to perform the same function, and so on, until all of the tiles are swiveled to their upright position.

In a more specific aspect of the invention, the track is constructed with spaced rods located therealong extending transverse the width of the track; the tiles contain a semi-cylindrical bottom surface with the center of gravity of the tile being located off-axis of the cylindrical axis of the bottom surface; and the tiles may be inserted onto associated rods that serve as pivot seats, In this arrangement the tiles may be arranged to topple in one direction and may be removed, reversed in position and permitted to topple in a reverse direction.

As will be appreciated with the present invention there is no need to raise the track in order to upright the tiles. Complete reversibility is assured. Further, by use of individual actuators, complicated mechanical structures are avoided.

Further as an additional feature, the actuators and the tiles may be integrally formed in a unitary one-piece molded structure, avoiding additional separate parts and the resultant complications of handling and assembling extra parts. Thus in a more specific aspect to the invention, the elements of the toy may be formed by an injection plastic molding process so as to produce all of the tile, actuators and track elements in a single mold shot from which the tiles and track may be simply detached.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, and the appended claims, taken together with the illustration thereof presented in the accompanying drawings.

DETAILED DESCRIPTION OF A PREFERRED EMBODIMENT

Figure 1:
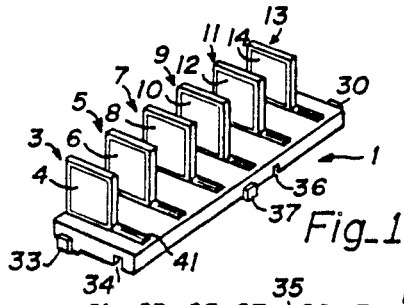
FIG. 1 illustrates a preferred embodiment of the invention in perspective view ready for operation.

Reference is made to FIG. 1 of the drawings which illustrates a preferred embodiment of the toppling toy in perspective view. The toy includes a base section or track 1 and six tile units 3, 5, 7, 9, 11, and 13, it being recognized that the length of the track and the number of tiles as may be included in length of track may be varied with six being preferred for reasons later discussed. Each tile unit contains a corresponding figure, flag, domino, chip, block or tile, as variously termed and collectively referred to as tiles, 4, 6, 8, 10, 12 and 14, with the tiles illustrated in the upright position ready for toppling. The base of each tile unit, such as 41 associated with tile 4, only one of which is labeled in the figure is seated on the track in a pivot arrangement that is not visible in this view and is later described in detail. Each tile unit is removable from the track. Each tile base includes an actuator portion at the right end of the tile base. The actuator portion is accessible to a players finger. As shown, the tile is laterally off-set in the tile unit. The track contains male connectors 30, 33 and 37 and female connectors 34 and 36 that are described in greater detail hereafter.

Figure 2A:
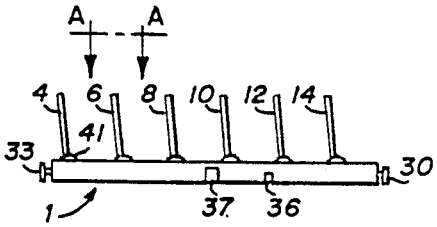
FIG. 2*a* illustrates the embodiment of FIG. 1 in right side elevation view.
Figure 2B:
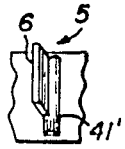
FIG. 2*b* is a partial section top elevation view of FIG. 2*a* taken along the lines A—A.

As shown in the side elevation view of FIG. 2*a*, the tiles 4 through 14, as installed in the track, are tilted slightly to the left off the vertical axis. Thus when viewing the assembly from the top, the tile does not sit fully vertically upright but more the appearance as presented in the partial section view of FIG. 2*b*.

The tile units may be removed from their position on the track and, as removed, appear as in FIGS. 5 through 10 forming a unitary assembly of the tile and the tile base that supports and carries the tile, as will be discussed in greater detail following a more detailed description of a preferred form of track 1, which immediately follows.

Figure 3:
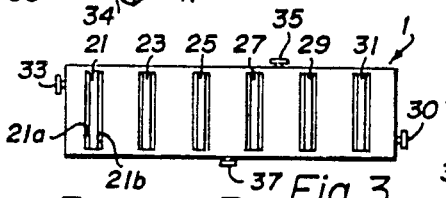
FIG. 3 illustrates a track used in the embodiment of FIG. 1 in top view.
Figure 4:
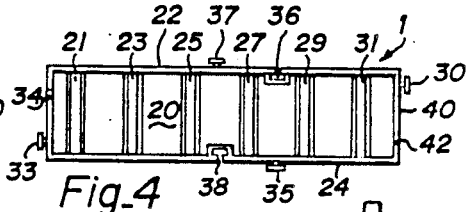
FIG. 4, the same element in a bottom elevation view.

As illustrated in top view in FIG. 3 and in bottom view in FIG. 4, which may be considered together, track 1 has a generally flat upper surface, downwardly depending side walls 22, 24, 28 and 40 and a series of six cylindrical shaped rod-like members 21, 23, 25, 27, 29, and 31. Those rod shaped members are oriented transverse the width of the track, extending across the width of the track between the right hand 22 and left hand 24 sides and serve as pivots on which the corresponding tile units are seated. At least the upper portion of the rods surface as viewed in FIG. 3 should be essentially of a smooth characteristic as minimizes friction, permitting the rod to effectively function as a pivot. An opening in the track, a slot, is provided on each side of each rod member, such as slots 21*a* and 21*b* associated with the first rod 21. The rods are spaced apart evenly from one another with the end rods being spaced from the respective adjacent front and back ends 28 and 40 of the track by approximately one half the distance as is provided for the rod to rod spacing internal of the track. Thus when the illustrated track section is coupled in line with another like track section, as contemplated in the present invention, the rod to rod spacing between the end rods of the two separate contiguous track sections is the same as the rod to rod spacing internal of the track as shown in the figure.

Suitable male type "T" connectors 30, 33, 35, and 37 and female slot connectors 32, 34, 36 and 38, visible in FIG. 4, are included for coupling the track section to additional sections of track. Any suitable form of connector may be integrally molded in the track as allows one section of track to be connected to another to form tracks of extended length. In the preferred form a combination of male and female connectors is used to join adjacent track sections. As shown in the bottom view of the track in FIG. 4 the projecting T-shaped male connector member 30 fits into the female slot (corresponding in shape and position to slot 34) on the adjacent track member with its T top end locked in place by the wall portions that border the corresponding slot. The end of one track is placed over the end of the other and the tracks are moved together vertically to make the connection.

Figure 12:
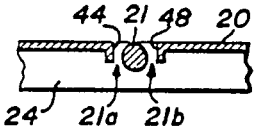
FIG. 12 is a partial section view of the track of FIG. 3 drawn to an enlarged scale to show details of the track.

The tracks depending side walls add rigidity to the track and elevate the tracks upper surface above the floor, table or other surface on which the toy is placed during play. As shown in FIGS. 4 and 12 the pivot rods, axles, are formed in and are contained entirely within the underside cavity formed within the underside of the track bounded by side walls 22, 24, 28 and 40 so the track may be solidly seated on the bottom edges of the side walls on a flat surface.

That tile unit is next considered in greater detail in FIGS. 5, 6, 7, 8, 9 and 10 illustrating tile unit 3, as example, in front, back, right and left side, and top and bottom views, respectively. As shown the tile unit contains a thin rectangular tile 4 connected to a base member 41 with the two parts formed in a one piece, a unitary assembly, suitably of plastic material. The elongated base section 41 serves as the base pivotally or swivelly supporting upwardly extending tile 4, with the width of the tile being less than the corresponding width, the length, of that base member, leaving exposed a portion of the base member and leaving the tile off-set in position on the base. The exposed portion of the tile unit base member is referred to as an actuator 45 for reasons that become more apparent hereinafter and in the preferred from that portion contains a knurled, grooved or otherwise roughened surface to enhance the frictional characteristic of that surface.

Figure 5:
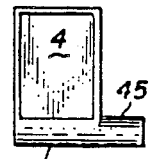
FIG. 5 illustrates in enlarged scale a tile assembly containing the toppling tile used in the embodiment of FIG. 1 in front elevation view and FIG. 6 shows that same element in a back elevation view, showing the reverse side.

The length of actuator 45, the distance from a side edge of the supported tile to the right end of the tile base as viewed in FIG. 5, is no less than the width of a players index finger; it may, however, be greater in length. As viewed from the back side in FIG. 6 base 41 is seen to contain an axially extending open channel 43, that extends the length of the base section. This channel is open at the front and back ends and along its length. The channel contains a smooth cylindrical surface 46 as is better illustrated in the respective right and left side views of FIGS. 7 and 8.

Figure 7:
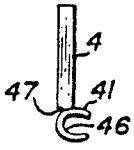
FIGS. 7 and 8 illustrate the tile unit of FIG. 5 in right and left side elevation views, respectively.
Figure 8:
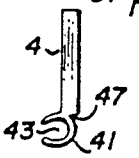

As presented in the enlarged section view of FIG. 7, the channel that forms the base or seat of the tile unit has an oblong cross section; that is a cylindrical surface 46 that corresponds in radius to a radius slightly greater than the radius of pivot rod 21, and two straight portions, unnumbered, that form the arms that fit over the rod. When in the down position, such as when the tiles are initially installed as illustrated in FIG. 13 in section view, the arm portions of the channel fit within and through the corresponding slots (21*a* and 21*b* in FIG. 12), located on either side of pivot rod 21, with the cylindrical portion being seated on and engaging the corresponding cylindrical surface of the rod.

The cylindrical surface of the channel effectively seats the tile unit onto the track's cylindrical shaped pivot rod, earlier described. As should be noted from these side views, the center of gravity of the tile in the tile assembly is located off-of the axis of channel 43 so as to lend stability to the tile and allow gravity to assist to retain the tile essentially upright when the tile is in the upright position as was illustrated in FIGS. 1 and 2 in addition to being off-set of the cylindrical axis of the cylindrical portion of the tile. The height axis of the tile is at a right or 90 degree angle to the direction of the side opening in channel 43; thus a line drawn through the cylindrical axis in the channel and the center of the side opening would extend in FIG. 8 horizontally to the left; whereas a line drawn through the tile along the height would be vertical in FIG. 8, forming a 90 degree angle with the first described line. The tile in this particular assembly protrudes from the rear of the tile base to define an edge 47 at the bottom side.

Figure 9:
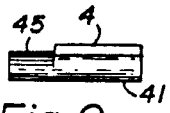
FIG. 9 illustrates the tile assembly of FIG. 5 in a top view and FIG. 10 shows that tile assembly in a bottom view.
Figure 10:
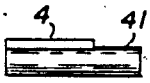

As viewed in the top view of FIG. 9 a portion of the knurled area 43 on actuator 45 is visible. Tile 4 is seen to be relatively thin and is located off of the axis of the coupling member, tile base 41.

Figure 11:
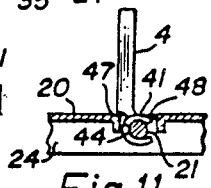
FIG. 11 is a partial side section view of the unit taken along lines B—B in FIG. 2*a* and drawn to an enlarged scale showing the tile in the upright position.
Figure 6:
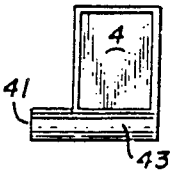
Figure 13:
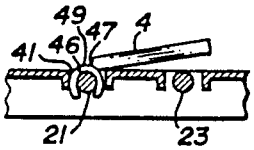
FIG. 13 is a partial section view of the track assembly taken along the lines B—B in the FIG. 15 and drawn to an enlarged scale, showing the tile in the prone position.

As shown in the partial section views of FIGS. 11, 12 and 13, rod 21 is disposed centrally within the rectangular shaped central opening in between and evenly spaced from the depending edges 44 and 48 leaving clearance spaces or slots, 21*a* and 21*b*. The base member 41 on the tile unit may be inserted through the slots as shown in the section view of FIG. 13 and be seated on the pivot formed by rod 21. For this purpose the radius of the rod is preferably less than half the width of the opening, the latter being the distance between edges 44 and 48.

Rod 21 is attached to or formed in the walls of the track at a location in which the axis of the rod is below the upper flat surface 22 by a distance equal to the rod's radius. Hence the flat upper surface of the track is tangent to the rod as illustrated in FIG. 12. The foregoing arrangement is preferred. As is apparent to those skilled in the art other embodiments may incorporate other relationships. For example, the upper surface need not be tangent to the pivot rod; and the width of the formed slots may differ from that described.

When the tile is raised upright, the relationship appears as depicted in FIG. 11. As illustrated the thickness of the tile and its position on the channel seat member is such as to permit a bottom edge of the tile to protrude or extend outwardly exposing a ridge or ledge 47. With the tile in its upright position as in FIG. 11 the back edge of tile unit base 41 abuts a side edge of the slot opening in this embodiment to prevent the tile from falling over in the wrong direction. In other embodiments, such as with an opening in the track of greater width than in this embodiment, the bottom edge 47 of the tile may be used for that purpose by engaging the top surface of the track.

Through such stop or stops carried by the tile unit, the tile is permitted to topple only in one down direction or position. By arranging the stop structure in this way additional elements for that purpose are avoided, which is viewed as an additional feature to the invention presented in the specific embodiment illustrated. As installed with the tile in its "down" position shown in FIG. 13, the clearance between the sides of member 41 and the top and bottom edges of the track opening is on the order of two to three millimeters.

Figure 14:
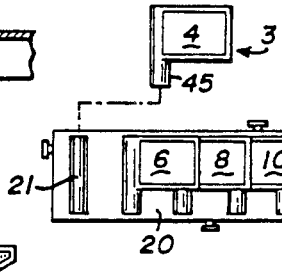
FIG. 14 illustrates the embodiment of FIG. 1 in a partial exploded top view taken with the tiles illustrated in the toppled or down position.

Reference is now made to FIG. 14 to next consider the assembly of the plurality of tile units onto the track. In this figure the toy is viewed in top plan view and the tiles are illustrated in the down position with tiles 6, 8, 10, 12 and 14 already assembled to the track. The remaining tile unit 3 containing tile 4, illustrated in exploded view, is oriented in the down position with the open side of its channel, not visible in this view but earlier illustrated in FIG. 13, oriented parallel and overlying the remaining rod 21. The tile unit is simply dropped into place on the corresponding rod, with the rod being received within the tile units channel and with the tile 4 overlying the corresponding tile 6 on the adjacent tile unit. With such simplicity of assembly, the toy is ready to be set and the tiles uprighted. This simple "drop-in" technique is used to install all the tiles in all of the tracks.

As shown all of the actuators 45 of all of the tile units are located on the bottom side in this FIG. 14, positioned in an imaginary corridor or lane along the right side of the path defined by the track. Using roadway terminology, that imaginary corridor or path is referred to as a finger dragging lane, while the remainder of the track's width may be regarded as a tile parking shoulder. Applying the index finger at the top end of the track and dragging the finger along the finger dragging lane, the players finger in sequence engages the frictional surface of the actuator of each of the installed tile units. With continued translational movement of the finger along the lane, the actuator rotates and thereby rotates the entire tile unit of which the actuator is an integral part, pivoting the associated tile and raising that tile to the upright position. Since the surfaces of the pivot are relatively of a low friction characteristic very small pressures need be exerted by the players finger and resetting is essentially effortless.

Figure 15:
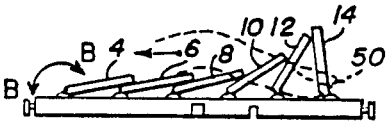
FIG. 15 illustrates the operation of resetting the tiles of the embodiment of FIG. 1 taken in side view.

The method of setting up or resetting the tiles is better presented in the side view of FIG. 15 to which reference is made. As shown tile 14 has been raised upright, tile 12 is in process of rotation, tile 10 is raised slightly by the force exerted through tile 12, and tiles 8, 6 and 4 are in the down position as the players finger, represented in phantom line 50, is being drawn to the left in the figure down along the finger dragging lane. As the players finger moves from actuator to actuator the moment or counter torque of the partially uplifted next succeeding tile is not sufficient to move the uprighted tile back to the down position before the players finger reaches the next actuator associated with the latter tile. Thus it is important to move the finger with a steady pace.

It was discovered that the frictional engagement between the finger and actuator is greater than any friction as exits between the pivot rod and the cylindrical surface of the channel in the base of the tile unit as permits such ready application of force by the finger to rotate the actuator. Thus instead of just sliding over the surface of the actuator, as in the case of the channel surface to pivot rod friction being more dominant, the finger instead rotates the actuator and the associated tile.

One can imagine a very lengthy and complicated track construction in which a large number of tracks are connected in a line. The player starts at the beginning and draws a finger along the lane to quickly set up the tiles. Should the player momentarily tire, he may stop and manually hold the last tile upraised so that it will not topple until the player is refreshed and continues with the finger dragging movement; doing so until the entire array of tiles is raised.

Brief reference is made again to FIG. 14. As shown the tiles are installed so that they fall to the right in the figure. However the tiles may be removed from the track, turned around, rotated, by 180 degrees and reinserted into the track with tile 4 being inserted first, tile 6 next and so on. When completed, the tiles are thus arranged to fall to the left in the figure; and the actuators, such as actuator 45 are then oriented on the top in the track, instead of at the bottom as illustrated. The finger dragging lane is then on the other side of the track and the players finger is dragged to the right to set the tiles upright. Thus the tiles are said to be easily reversible.

The term tiles was used to designate the upright members. However, it should be understood that the term as used in the claims would apply to any other shaped figure that might be substituted for the rectangular shaped tiles illustrated. For instance, instead of such rectangular shaped tiles a series of blocks shaped to represent toy soldiers might be substituted or the tiles might be shaped to represent numerals, letters or other figures without departing from the present invention. The tiles may contain a prescribed number, letter or other marking on its surface. They may be readily removed from one slot and rearranged with respect to the track to spell specific words, depict the sum of two or more numbers, form a specific message design or the like. In still other embodiments they may be decorated to form animal or fantasy characters.

In alternative embodiments it might be preferable not to lock adjacent sections of track together; the track may be placed side by side. In that embodiment, the resetting operation described need be accomplished with greater care so as to avoid pushing one section of track away from a former section as the player drags his finger across the edge of the track.

Suitably the tile units and track are formed of injection molding of plastic material, suitably high impact polystyrene, by conventional plastics molding processes, which are conventional and need not be discussed further. An alternative plastic is known as polystyrene.

Figure 16:
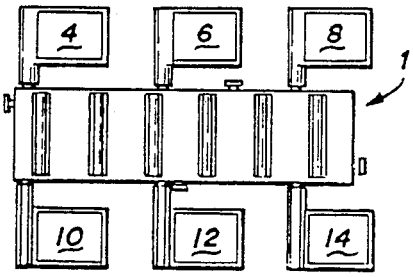
FIG. 16 illustrates the elements of FIG. 1 as taken from the mold in one fabrication technique.

In production it is expected that the elements needed to form a single track section are preferably molded in a single "shot" and are removed from the mold cavity substantially as illustrated in FIG. 16 in which the elements are identified by the same numbers as before. Further there is no need to detach the tile units from the track section a this step and the entire assembly may be packaged and delivered to the customer in the illustrated form; in which case the purchaser ultimately detaches the component elements to initially set up the toy. Packaging and shipping in this form minimizes inconvenience to the customer as would result from a lost tile requiring replacement.

While the preferred embodiment employs the same plastic material for both the tile unit and the track, it is recognized that different plastics may be used for those elements in different embodiments; the same color is presented for each tile, but different colors may instead be used; and even though the tile unit contains the flag, actuator and seat member as an integrally formed unit, it is possible to make those elements in separate members and then join the elements together to practice the invention, although such is clearly recognized by those skilled in the art as being less preferred than the specific arrangement shown. While the track illustrated in the foregoing description was straight, it is apparent that track may be curved.

Figure 17:
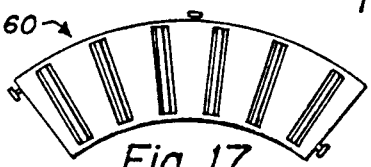
FIG. 17 illustrates in top view an alternative form of track used in the toppling toy.

FIG. 17 illustrates a curved section of track. The track also contains six pivot locations and accompanying slots. Except for the curve its construction is identical to the straight section. Two or more sections of track can be joined together to form longer tracks as depicted in FIG. 19.

Figure 18:
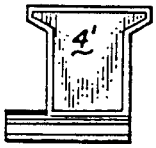
FIG. 18 illustrates an alternative form of T-shaped tile useful in alternative embodiments of the invention.

FIG. 18 illustrates a tile unit containing a tile that is not of rectangular geometry. Instead the tile contains two extending tongues or arms. This geometry is useful in case a Y-type track configuration is used. That is two straight branches are arranged with a third to form a Y shape. And it is desired that falling tiles on the stem section cause toppling concurrently of tiles arranged in each arm of the Y. Such a geometry for the tile assures that the tile when toppled strikes the tiles of the adjacent tracks of the two arms of the formed Y.

Figure 19:
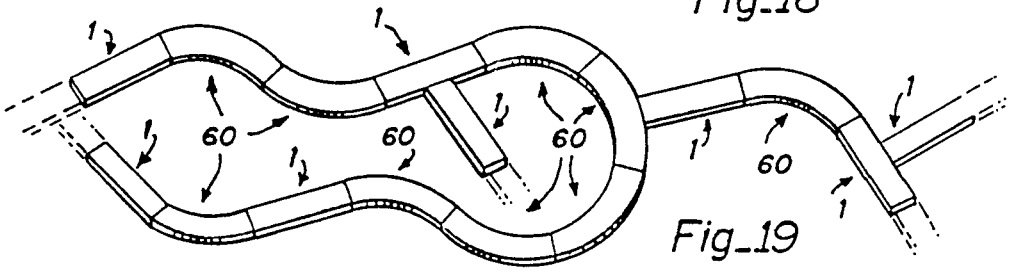
FIG. 19 shows one possible layout of a large number of track sections as forms a playset.

FIG. 19 illustrates pictorially one possible track arrangement in which sections of straight and curved track are connected to provide play. By way of example, a first series of tile units may be arranged in the track around the loop to the left in the figure so as to topple from the upper left around the loop to the track end at the lower left. In that series one of the tile units would be of T shape in FIG. 18 located at the bend in the loop in the middle of the figure adjacent the straight section extending to the right in that figure. The track section to the right contains another series of tiles arranged to fall to the right, with the first tile in that series positioned to be struck and knocked over by an end of the described T shaped tile.

The embodiment is versatile. The tiles can be made to pivot to the right as shown in FIG. 1, or to the left by merely removing the tiles and turning them around 180 degrees and reinserting the tiles into the track. Hence the tiles are reversible. In one form of play all the tiles are mounted on the track so that they pivot in the same direction. In still other modes of play, a portion of the tile units on a track assembly are reversed in position from another position so as to form two series of toppling tiles, one of which topples in one direction and the other of which topples in the opposite direction. The toppling fans outwardly from a central location in that mode of play.

When the tiles are in the down position, they can readily be pivoted to an upright position also by grasping the track and raising the end so that the chips pivot to the upright position as was the way certain prior art toys were reset. Since the pivot seat has two arms the tile unit should not separate from the base. By carefully placing the base on a horizontal surface, the tiles will remain in the upright position, especially if they are made to lean forward slightly as described above. While this may be an alternative mode of resetting the tiles upright, it is obviously not practical for extended lengths of track. With the tiles upright, the whole assembly may be turned upside down and the tile units do not fall off the track. An arm of the channel abuts against the rod to hold the unit in place.

By way of specific example and not of limitation, a practical embodiment of the tile assembly included a tile of rectangular shape of 1 inch by 1.25 inches and $\frac{1}{8}$th inch in thickness mounted to a base member of 1.5 inches in length. The overall height of the tile unit assembly is 1.56 inches. The channel included a semi-cylindrical section of a diameter of $\frac{3}{8}$ths of an inch and depending wall lengths of about $\frac{1}{8}$th inch. The weight of the entire tile assembly was 0.10 ounces. One side of the tile was mounted flush with one end of the base member leaving an extended portion, the actuator, of $\frac{1}{2}$ inch. The surface of the channel was smooth or glass like so as to have a low coefficient of friction when engaging the pivot. The tile was off the axis of the cylindrical axis of the channel as measured from the center of the tiles thickness by approximately 3/16th of an inch and was tilted relative to the side channel walls by an angle of 90 degrees. The thickness of the tile was $\frac{1}{8}$th inch. The bottom edge of the tile protruded by 1/16th inch. A specific example, a straight track measures approximately six inches in length and $1\frac{5}{8}$th inches in width and 5/16ths inches in height. The rods are just under 3/16th inch in diameter and the track weighs in at 0.6 ounces.

As those skilled in the art appreciate specific features of the embodiment may be modified to less preferred forms, all of which come within the scope of the invention presented herein, some of which have earlier been described. For example, although one practical embodiment of the invention employs a rod like pivot on the track and a partially ensleeving channel having a semi-cylindrical surface as the remaining portion of the pivotable coupling, other practical embodiments may employ those elements in reverse position with adjustment to the structure. In that alternative arrangement the base member to the tile would be of half rod like shape protrusion, except the extending portion which would be of a cylindrical rod shape, and the base member engage a semi-cylindrical seat recessed in the surface of the track. There would be no need for slots in the track. While retaining the reset structure that alternative arrangement however is less preferred since it is not as easy to retain the tile assembly in the track and would not permit all of the functions and benefits of the preferred embodiment.

Another form to the track allows for the tracks pivot rods to be semi-cylindrical or half moon in cross-section shape instead of the cylindrical shape shown, and in which the cylindrical surface faces upward in the track. In this form sufficient surface is available to allow for pivoting of the tile unit on the half cylinder shaped rod, while some savings in plastic material is achievable. However the tiles would not be as securely held in the track, as if the track is inverted for example, as with the preferred form. A like modification as could save plastic is to incorporate an extending slot into the underside of the tracks pivot rods, essentially hollowing out the rod while retaining most of the cylindrical shape of the outer surface. Though not a full cylinder in shape the pivot rod is more than a half cylinder as in the preceding case.

In an additional alternative embodiment one may employ two short rod like portions on the right and left side walls of the track, respectively, forming less than a complete rod as in the preferred embodiment. This alternative uses less plastic and is less preferred since it lessens the rigidity of the track and may result in molding difficulties if the two short rod like stubs become axially misaligned during manufacture.

Although the member 1 is referred to as a track, it may be referred to as a base or foundation or like term. The member serves as a base for pivotally supporting the tiles. Accordingly the use of that term is intended to be used in its broadest sense. Further, the pivotable member in such a toppling toy combination is referred to by many different terms, such as blocks, dominos, flags, chips, figures or tiles. Whatever term may be chosen as a preference they are understood to operate in the combination in the same way irrespective of shape and/or decoration and in essence have the same meaning in this application. For consistency in this specification and ease of understanding the term tile was selected to refer to the pivotable member, it being understood that any one of the other terms or even pivotable member may be used interchangeably in place of that term without affecting the meaning in this specification or claims and that the term tile is not to be construed as limited to a particular geometric configuration, such as a square.

It is believed that the foregoing description of the preferred embodiment of the invention is sufficient in detail to enable one skilled in the art to make and use the invention. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. A toppling toy, comprising a track having an upper surface, a series of tiles each being pivotally mounted to said track to permit said tiles to swivel between a generally upstanding position, said tiles being spaced apart a distance to permit a toppling tile to engage an adjacent upstanding tile and cause said adjacent tile to tip over to create a domino effect with the tiles of said series; and reset means for resetting said tiles from said down position to an upstanding position, said means comprising:

a plurality of actuators, one associated with and coupled to a corresponding one of said tiles for joint pivotal movement with said associated tile about a common pivot axis;

each said actuator being pivotally mounted on said track with its pivot axis oriented transverse said track;

each said actuator containing an outer surface exposed on the upper surface of said track to a players finger, said track having sufficient width to accommodate said actuator and a player's finger said outer surface of said actuator having a frictional characteristic, whereby dragging movement of the players finger along the upper surface of the track and across and in a direction transverse the actuator axis of pivot creates a torque thereon for pivoting the actuator to thereby upright said associated tile.

2. The invention as defined in claim 1, wherein said track contains a plurality of spaced pivots, one associated with each of said tiles; and further comprising a plurality of tile base means, each of said plurality of tile base means being coupled to a corresponding one of said plurality of tiles for pivotally supporting an associated tile to a corresponding one of said plurality of pivots; and wherein an associated one of said actuator means is connected to said tile base means for joint pivotal movement therewith.

3. The invention as defined in claim 2 wherein each of said actuator means is integral with said associated one of said tile base means to define a unitary one piece assembly and said associated actuator means is mounted to the same pivot as said associated tile base means.

4. The invention as defined in claim 3 wherein said actuator means includes a generally cylindrical shaped outer surface portion; said outer surface portion containing a plurality of spaced parallel grooves with said grooves extending parallel to the axis of said pivot.

5. The invention as defined in claim 1 wherein said actuator means includes a generally cylindrical shaped outer surface portion; said outer surface portion containing a plurality of spaced parallel grooves with said grooves extending parallel to the axis of said pivot.

6. A tile unit for use in a track of a toppling tile game, comprising in a unitary one piece molded assembly of plastic material:

a tile, said tile having top and bottom ends with said bottom end being of a first predetermined width;

a tile base member for supporting said tile, said tile base member being of a second predetermined width, said second predetermined width being greater than said first predetermined width, with said bottom end of said tile being connected to said tile base member at a position off of the center of said tile base member to define an extended portion to said base member to define an actuator accessible to a player's finger; and said tile base member further including a pivot member for pivotally seating said tile on a track;

said pivot member including walls defining an open channel, with said channel extending said second predetermined width with said channel including a semi-cylindrical shaped bottom surface and an open front and back ends;

said bottom of said tile further being connected to said base member at a position off the axis of said semi-cylindrical shaped bottom surface; and wherein at least said extended portion of said tile base member contains a generally cylindrical shaped outer surface with said outer surface containing a plurality of longitudinally extending spaced grooves.

7. The invention as defined in claim 6 wherein said channel is oriented at a right angle to said tile.

8. A toppling toy, comprising:

track means, said track means comprising an elongated surface defining a path having right and left sides and a finger dragging lane on said surface for permitting a players finger to be drawn along an upper surface of said track means;

a plurality of tile means pivotally mounted in said track means, each said tile means being located on said track means and containing a tile adapted to be pivoted between an upright position and a down position to one side of said upright position;

each said tile means of said plurality being positioned proximate one another to permit a given tile of one tile means to strike the next most adjacent tile of an adjacent tile means upon pivotal movement of said given tile from the upright to said down position to cause said adjacent tile to pivot in turn from the upright to the down position, whereby toppling said given tile creates a chain reaction causing all succeeding tiles in said plurality to pivot in sequence from the upright to the down position;

each said tile means including mechanical actuator means, said actuator means being pivotally mounted in said track transverse the length of said track and integrally connected with and extending to one side of an associated tile for concurrent pivotal movement with said associated tile for permitting movement of said associated tile from the down position to the upright position responsive to pivoting of said actuator means;

said mechanical actuator means being located in and extending transverse of said finger dragging lane of said track means, with said actuator means being positioned to frictionally engage a players finger dragged along said finger dragging lane and translate movement of said players finger to pivotal movement of said associated tile for raising said tile to the upright position; whereby a player may set all of the tiles to an upright position by dragging the players finger along the length of said finger dragging lane.

9. The invention as defined in claim 8, further including:

stop means for retaining said tile in said upright position and preventing said tile means from falling over to a second down position reverse of said down position.

10. The invention as defined in claim 9 wherein said stop means is carried by said tile means.

11. The invention as defined in claim 8, further including:

means for pivotally coupling said tile means to said support base, comprising: a channel with said channel containing a semi-cylindrical surface.

12. The invention as defined in claim 8 wherein each said tile means may be lifted from said pivotal coupling to remove said tiles from said track.

13. The invention as defined in claim 8 wherein said track means comprises a plurality of discrete tracks with said tracks containing connector means for connecting to other tracks.

14. The invention as defined in claim 8, wherein said track means includes a plurality of openings an upper surface thereof; a plurality of cylindrical shafts, with said shafts being spaced from one another and with each said shaft being positioned within a corresponding one of said plurality of openings in said track and extending between the right and left sides of said track; and each of said shafts for pivotally supporting a corresponding one of plurality of tile means and actuator means.

15. The invention as defined in claim 14, wherein said tile means includes: a channel containing a concave semi-cylindrical bottom surface for coupling to and pivotal movement on said associated shaft; said semi-cylindrical surface extending in a line through the associated tile and actuator means.

16. The invention as defined in claim 15, wherein said actuator means further comprises: a cylindrical outer surface with said outer surface containing grooves therein to increase the frictional characteristics of said outer surface to thereby enhance frictional engagement with a players finger.

17. The invention as defined in claim 16 wherein said grooves are parallel to one another and oriented in a direction transverse the axis of the actuator means.

18. The invention as defined in claim 14 wherein said tile carried by said tile means further includes a thin relatively flat rectangular geometry, said tile means being mounted off the axis of pivot;

said tile means further including a side surface for engaging one side of the associated opening in said track surface to prevent movement of said tile means from the upright position to a second down position in a second direction opposite the direction of said first described down position.

19. The invention as defined in claim 8 wherein said actuator and tile means comprise a unitary structure of molded plastic material.

20. The invention as defined in claim 15 wherein in each said tile means said channel is oriented facing in one direction and wherein said tile is oriented in a direction perpendicular thereto.

21. A toppling toy comprising:

a track, said track containing a first lane for permitting a player to drag a finger therealong;

a plurality of toppling tile means for installation in said track at spaced positions therealong, each said toppling tile means comprising in a unitary one piece molded assembly:

a tile, said tile having top and bottom ends with said bottom end being of a predetermined length;

a tile base member for holding said tile, said tile base member being of a greater length than said predetermined length of said tile, with said bottom end of said tile being connected to and positioned relative to said tile base member to leave an extended portion to said tile base member accessible to a finger, said extended portion being unobstructed by said tile and defining an actuator; and said tile base member further containing a pivot portion for pivotally seating said toppling tile means on said track in a pivotable relationship with said track;

said toppling tile means being installed on said track with said actuator being located within and extending transverse said first lane of said track; said actuator comprising a frictional element whereby a player may pivot a toppling tile means from the down to the upright position by dragging a finger along said first lane of said track to engage and pivot each of the plurality of actuators sequentially and hereby upright said tile means.

22. The invention as defined in claim 21 wherein said base member pivot portion further comprises a channel, said channel containing a semi-cylindrical shaped bottom surface.

23. The invention as defined in claim 22 wherein said channel includes an open front and back end; and wherein said track means further comprises:

an elongate body of a predetermined length, said body including an elongate flat upper surface to form an extending track surface and right and left side walls depending downwardly from said upper surface and bordering said predetermined length thereof;

a plurality of openings in said upper surface with said openings being oriented transverse the length of said surface and extending between said right and left side walls, said openings being of a predetermined width of a generally rectangular shape and of uniform size;

a plurality of cylindrical rods of a predetermined diameter, one of said plurality of rods being associated with a corresponding one of said plurality of openings;

each said rod extending between and supported by said right and left side walls and being disposed central of said corresponding opening to obstruct a center portion of said opening;

each said rod having a predetermined radius with said predetermined radius being less than one half said predetermined width of said corresponding opening to define a pair of slot like openings between the surface and the side of said associated rod; and wherein said channel of a tile means seats to a corresponding one of said rods, whereby said tile may be pivoted on said rod.

24. The invention as defined in claim 22 wherein said channel includes an open front and back end; and wherein said track means further comprises:

an elongate body of a predetermined length, said body including an elongate flat upper surface to form an extending track surface and right and left side walls depending downwardly from said upper surface and bordering said predetermined length thereof;

a plurality of openings in said upper surface with said openings being oriented transverse the length of said surface;

a plurality of pivot rods, one of said plurality of pivot rods being associated with a corresponding one of said plurality of openings;

each said rod extending between and supported by said right and left side walls and being disposed central of said corresponding opening;

each said pivot rod having a cylindrical surface exposed to said upper track surface; and wherein said channel of a tile means seats pivotally to a corresponding one of said rods, whereby said tile may be pivoted on said rod.

25. In combination with a toppling toy of the kind containing a pivotable tile, a track for pivotally supporting said tile comprising:

an elongate body of a predetermined length, said body including an elongate flat upper surface to form an extending track surface and right and left side walls depending downwardly from said upper surface;

a plurality of openings in said upper surface with said openings being oriented transverse the length of said surface and extending between said right and left side walls, said openings being of a predetermined width of a rectangular shape and of uniform size;

a plurality of rods of a predetermined diameter, one of said plurality of rods being associated with a corresponding one of said plurality of openings;

each said rod extending between and supported by said right and left side walls and being disposed central of said corresponding opening to obstruct a portion of said opening;

each said rod having at least an upper surface that is of a cylindrical shape, said shape being of a predetermined radius with said predetermined radius being less than one half said predetermined width of said corresponding opening to define a pair of slot like openings between the surface and the side of said associated rod; and wherein said pivotable tile includes means for pivotally seating to one of said rods, whereby said tile may be pivoted on a rod.

26. The invention as defined in claim 25, wherein each said rod contains a cylindrical axis; and wherein said cylindrical axis of said cylindrical surface of said rod is located at a position on said side walls underlying said upper surface at a distance equal to said radius of said rod to cause said upper surface to appear tangent to said cylindrical surface of said rod.

27. The invention as defined in claim 25 wherein said rod comprises a cylindrical shape of said predetermined radius.

* * * * *